United States Patent [19]

Gamble

[11] 4,016,359

[45] Apr. 5, 1977

[54] INSULATING BUSHING ASSEMBLY

[75] Inventor: James R. Gamble, Greensburg, Pa.

[73] Assignee: Westinghouse Electric Corporation, Pittsburgh, Pa.

[22] Filed: Nov. 28, 1975

[21] Appl. No.: 636,284

[52] U.S. Cl. ..... 174/153 R; 248/27.3; 339/126 RS

[51] Int. Cl.[2] ..... H01B 17/30

[58] Field of Search ..... 174/142, 152 G, 153 R, 174/153 G; 339/94 A, 126 R, 126 RS; 248/27; 240/152; 285/205, 318; 403/261

[56] References Cited

UNITED STATES PATENTS

| | | | |
|---|---|---|---|
| 1,010,592 | 12/1911 | Cole | 174/153 G X |
| 1,167,279 | 1/1916 | Elliot | 240/152 |
| 1,191,192 | 7/1916 | Klein | 174/152 G X |
| 3,708,612 | 1/1973 | Saxon et al. | 174/153 R X |

FOREIGN PATENTS OR APPLICATIONS

| | | | |
|---|---|---|---|
| 1,039,946 | 5/1953 | France | 174/153 R |
| 23,877 | 12/1900 | United Kingdom | 174/153 G |
| 586,415 | 3/1947 | United Kingdom | 174/153 G |
| 878,221 | 9/1961 | United Kingdom | 339/126 RS |
| 886,687 | 1/1962 | United Kingdom | 339/126 RS |

*Primary Examiner*—Laramie E. Askin
*Attorney, Agent, or Firm*—L. P. Johns

[57] ABSTRACT

An insulating bushing assembly for use with electrical apparatus and adapted to be installed through an aperture in a wall thereof, characterized by an electrically insulating bushing extending through an aperture in the wall and sealed in place by an elastic gasket between the bushing and the wall on one side thereof, the bushing having an annular groove on the other side of the wall and a garter spring disposed in the groove and having a smaller portion thereof extending beyond the groove and in contact with the other side of the wall, whereby the elastic gasket is retained in fluid-tight compression between the bushing and the wall.

1 Claim, 2 Drawing Figures

INSULATING BUSHING ASSEMBLY

BACKGROUND OF THE INVENTION

1. Field of the Invention

This invention relates to an insulating bushing assembly for electrical devices such as distribution transformers.

2. Description of the Prior Art

Insulating bushings are used to mount an electrical conductor through a metal wall or cover of an electrical apparatus, such as a high voltage bushing on the cover of an electrical transformer. Examples of such bushings are disclosed in U.S. Pat. Nos. 1,010,592, 2,495,252, 2,953,628, 3,096,392, 3,116,362, and 3,278,833. In those patents the bushings are mounted in place by retaining means that have disadvantages including a multiplicity of parts as well as insufficient self-adjusting ability.

Associated with the foregoing has been the problem of large tolerance variations on finished porcelain bushings. Indeed, the large variation in tolerances has been the primary reason for attempts to compensate for the bushing size such as disclosed in the above listed patents. Bushings composed of epoxy resins are produced without any variations in tolerance, but epoxy resins are more costly than the more conventional materials.

SUMMARY OF THE INVENTION

It has been found in accordance with this invention that the foregoing problems may be overcome by providing an insulating bushing assembly comprising an electrically insulating bushing having an enlarged head portion and a reduced longitudinal portion dimensioned for insertion through an aperture in the wall of cover of electical apparatus, the enlarged head portion having an annular shoulder abuttable with one side of the wall, an elastic gasket between the shoulder and the wall, the reduced longitudinal portion having an annular groove located at a position substantially at the other side of the wall, the groove having an inclined surface portion extending inwardly from the outer surface of the reduced longitudinal portion to an outturned surface portion of the groove, an annular coil spring in the groove and having an annular axis whose radius is less than that of the reduced longitudinal portion, the annular coil spring and the bushing having an effective diameter greater than that of said aperture, and the elastic gasket being compressed between the shoulder and said one side to clamp the spring against the inner surface portion, whereby the elastic gasket is retained in fluid-tight compression between the shoulder and the wall.

The advantage of the insulating bushing assembly of this invention is that it provides for automatic selfadjustment of the bushing to the cover of the electrical apparatus notwithstanding variations in the tolerances of a bushing during manufacture.

DESCRIPTION OF THE PREFERRED EMBODIMENT

Figure 1:
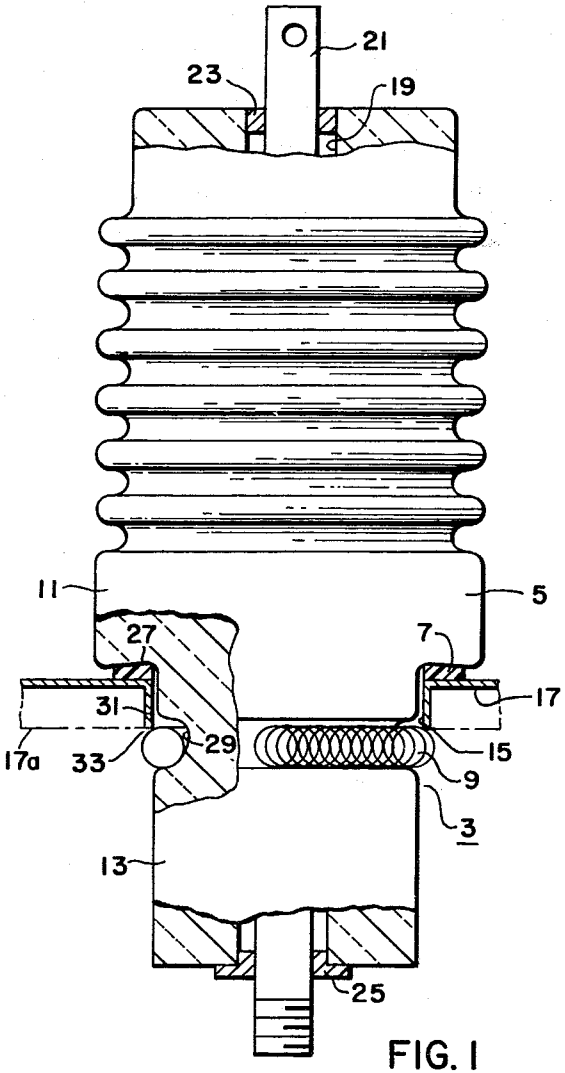
FIG. 1 is a vertical sectional view, partly in elevation, of a bushing assembly.

In FIG. 1 a bushing assembly is generally indicated at 3 and it comprises a bushing 5, an annular gasket 7, and a coil or garter spring 9. The bushing 5 is a member composed of an electrically insulating material, such as porcelain. It includes an enlarged or head portion 11 and a reduced longitudinal portion 13 having an outer diameter of a size suitable to extend through a hole 15 of a wall or cover 17 of an electrical apparatus such as a distribution transformer. The bushing 5 includes a longitudinal bore 19 which is coextensive with the bushing and through which a high voltage conductor 21 extends in a conventional manner. An annular spacer 23 is disposed at the upper end of the bore and a mounting nut 25 is provided at the lower end of the bore for maintaining the conductor 21 axially within the bore. An annular inturned shoulder 27 is disposed between the head portion 11 and the reduced portion 13 and the annular gasket 7 is disposed between the shoulder and the outer surface of the wall 17. Below the shoulder 27 an annular groove 29 is provided at the outer surface of the reduced portion 13 and the coil spring 9 is seated within the groove.

The wall 17 may have a thickness such as shown by the solid lines in FIG. 1 or a thicker dimension such as shown by the broken line 17. For a wall 17 of smaller dimension an inturned flange 31 may be provided for reinforcing the area around the hole or aperture 15. Whether a wall of smaller or greater thickness is provided is immaterial so long as it supports the bushing assembly 3. Suffice it to say, a corner 33 of the wall 17 is provided for contact with the annular coil spring 9.

Figure 2:
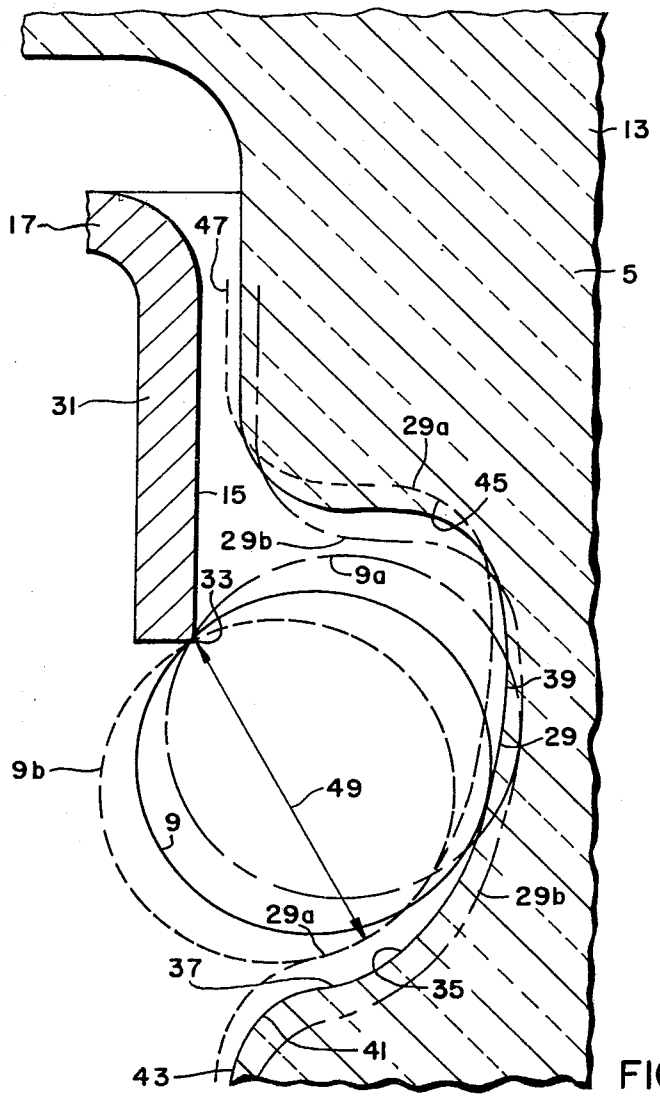
FIG. 2 is an enlarged sectional view showing the various positions of the coil spring in response to the tolerance variations in the size of the bushing.

As shown more particularly in FIG. 2, the annular groove 29 has an inturned inclined surface portion 35 extending substantially from a location 37 inwardly and upwardly to another location 39. The general configuration of the surface portion 35 is inclined inwardly and upwardly, preferably on an arcuate surface having the shape as shown. The portion of the groove to the left (as viewed in FIG. 2) of the location 37 is a rounded corner 41 preferably having a suitable radius merging with the surface portion 35 as well as with the outer surface at 43 of the reduced portion 13. In the alternative the rounded corner 41 may be replaced with a square corner, but the rounded corner is preferred. The rounded corner 41 facilitates placement of the coil spring 9 in the groove.

The groove 29 also includes an outturned surface portion 45 extending from the location 39 to a location 47 at which locations the surface portion merges into the surface portion 35 as well as the outer surface of the portion 13. For illustration, variations in the dimensions of the groove 29 due to shrinkage tolerances are indicated by the broken lines 29*a* and 29*b*.

The coil or garter spring 9 is an annular spring which is positioned in the groove 29 and which has an inner circumference less than that of the groove at its minimum diameter, so that when the spring is disposed in the groove, it automatically positions itself at the location in the groove of maximum resistance to contraction of the spring. The center axis of the spring has a radius less than that of the outer surface of the reduced portion 13 so that a greater portion of the spring is disposed within the groove. Various positions of the spring 9 are indicated by the broken line positions 9*a* and 9b corresponding to the groove surfaces 29a and 29b.

In operation, as shown in FIG. 1, when the bushing 5 is inserted into the hole 15, the gasket 7 being composed of a material of substantial resiliency, such as rubber or neoprene, is compressed between the wall 17 and the shoulder 27 a distance sufficient to enable insertion of the spring into the groove 29. For that purpose, the spring is rolled over the surface of the reduced portion 13 upwardly from the lower end thereof until it passes into the groove and comes into contact on one side with the inturned surface portion 35 and the corner 33 of the wall 17 or 17a. Manifestly, the gasket 7 is compressed for a distance sufficient to provide a clearance, such as indicated by an imaginary line 49, extending between the corner 33 and the closest point of the surface 29a which line is greater than the diameter of the spring 9 to enable insertion of the spring into the groove. Thereafter upon release of pressure on the gasket 7, the gasket applies pressure upon the bushing so that the corner 33 engages the spring 9 and causes it to move inwardly against the inturned surface portion 35 until the spring itself resists further movement. Thus, the spring rolls or attempts to roll counterclockwise, as viewed in FIG. 2, about the corner 33 which is the center of rotation of such rolling of the spring. Inasmuch as the spring 9 has a diameter greater than the depth of the groove 29, the corner 33 engages the spring 9 in response to the slight expansion of the gasket 7 and the spring rotates almost imperceptibly into place where it resists further expansion of the gasket 7.

As shown in FIG. 2 the groove 29 is located in alignment with the corner 33 with the upper and lower sides of the groove being disposed on opposite sides of the corner. The total effective diameter of a groove surface and the spring 9 is greater than the diameter of the hole or aperture 15.

In conclusion, the bushing assembly of this invention provides for automatic self-adjustment of a bushing within the hole of a transformer cover in a fluid-tight manner and compensates for large variations of shrinkage tolerances inherent in the manufacture of bushings of the porcelain type. Moreover, the device of this invention accepts the large tolerances and adjusts to them automatically to lock the bushing in place and maintain compression on the gasket. Finally, it is therefore necessary that the gasket be composed of a material having suitable resilient properties and does not include gaskets having substantially minimal or no resiliency such as a corktype gasket.

I claim:

1. An insulating bushing assembly extending through an aperture in a wall of electrical apparatus, comprising:

a. An electrically insulating bushing having an enlarged portion and a reduced portion and having an annular shoulder between said portions, the reduced portion extending through the aperture and having an annular groove spaced from the shoulder;

b. an elastic gasket between the shoulder and the wall;

c. an annular coil spring in the groove and having a cross sectional diameter greater than the depth of the groove and substantially less than the width of the groove at the surface of the reduced portion, and d. the spring contacting a peripheral corner of the aperture on the side of the wall opposite the gasket and external of the reduced portion to enable the spring to roll on an inturned surface portion of the groove radially inwardly of the groove with the corner as the center of spring rotation into tight contact between the groove surface and the corner in response to expansion of the gasket, whereby the elastic gasket is retained in fluid-tight compression between the bushing and the wall.

* * * * *